US008256879B2

(12) United States Patent
Miyajima

(10) Patent No.: US 8,256,879 B2
(45) Date of Patent: Sep. 4, 2012

(54) SELF-SEALING UNIT, LIQUID EJECTING HEAD UNIT AND LIQUID EJECTING APPARATUS

(75) Inventor: Hiroki Miyajima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

(21) Appl. No.: 12/752,338

(22) Filed: Apr. 1, 2010

(65) Prior Publication Data

US 2010/0253752 A1 Oct. 7, 2010

(30) Foreign Application Priority Data

Apr. 2, 2009 (JP) ..... 2009-090487

(51) Int. Cl.
*B41J 2/175* (2006.01)

(52) U.S. Cl. ..... 347/84; 347/85

(58) Field of Classification Search ..... 347/84, 347/85, 86, 87

See application file for complete search history.

(56) References Cited

U.S. PATENT DOCUMENTS

| | | | | |
|---|---|---|---|---|
| 5,732,751 | A * | 3/1998 | Schmidt et al. | 141/48 |
| 6,000,788 | A * | 12/1999 | Iida | 347/86 |
| 6,585,358 | B2 * | 7/2003 | Usui et al. | 347/85 |
| 6,837,575 | B2 * | 1/2005 | Usui | 347/85 |
| 7,156,507 | B2 | 1/2007 | Aruga et al. | |

FOREIGN PATENT DOCUMENTS

JP 3606282 1/2005

* cited by examiner

*Primary Examiner* — Anh T. N. Vo
(74) *Attorney, Agent, or Firm* — Workman Nydegger

(57) ABSTRACT

A self-sealing unit has a liquid supply route for supplying liquid to a liquid ejecting head. The self-sealing unit includes a pressure chamber on the liquid supply route and a valving element that opens or closes the liquid supply route to supply the liquid. A biasing member biases the valving element to close the liquid supply route. A film is fixed to the body of the self-sealing unit to demarcate the pressure chamber and causes the valving element to open by being displaced toward the pressure chamber side by a negative pressure acting in the pressure chamber. A convex section is positioned between the valving element and a wall surface of the pressure chamber. The distance between the valving element and the wall surface is shorter than that in other areas, away from the valving element and the wall surface such that the convex section supports the film.

15 Claims, 6 Drawing Sheets

SELF-SEALING UNIT, LIQUID EJECTING HEAD UNIT AND LIQUID EJECTING APPARATUS

BACKGROUND

1. Technical Field

The present invention relates to a self-sealing unit, a liquid ejecting head unit and a liquid ejecting apparatus, and, particularly, the present invention is useful when it is applied to the case of opening and closing a liquid supply route by moving a valving element by a film which deflects with fluctuation of pressure in a pressure chamber.

2. Related Art

As a typical example of a liquid ejecting head, for example, an ink ejecting head is known which discharges an ink drop from a nozzle opening by using a pressure which acts on ink in a pressure generating chamber due to displacement of a piezoelectric element. The ink ejecting head according to the related art discharges ink supplied from a liquid source such as an ink cartridge filled with ink, from a nozzle by driving a pressure generator such as a piezoelectric element and a heating element. For example, by inserting an ink supply needle into an ink cartridge, ink in the ink cartridge is introduced to a reservoir, which is a common liquid chamber of the liquid ejecting head, from an introduction hole of the ink supply needle.

Some of ink ejecting heads of this kind are such that is combined with a self-sealing unit provided on a flow path for supplying ink for the ink ejecting head from a liquid supply source, such as an ink cartridge, to constitute an ink ejecting head unit. When a negative pressure occurs inside a reservoir by an ink drop being discharged from a nozzle opening, the self-sealing unit of such an ink ejecting head unit opens a valving element to supply ink from an ink cartridge to the reservoir of the ink ejecting head. Accordingly, the self-sealing unit is a part of a flow path provided with a valving element, and a pressure chamber in which the negative pressure acts is formed in its body in which the ink flow path is formed. The pressure chamber is formed by covering its opening section with a film. Thus, the valving element is pressed by the film deflecting toward the pressure chamber side due to the negative pressure which acts in the pressure chamber, and the valving element moves by the pressing force and opens the flow path.

Japanese Patent No. 3,606,282 discloses, as a related art, a self-sealing unit having such a self-sealing function.

In general, the pressure chamber of the self-sealing unit as described above is round. Accordingly, it is optimal to arrange the valving element at the center of the pressure chamber. However, the actual situation is that the position of the valving element is set eccentrically from the center of the pressure chamber because of the relationship with surrounding members. A film covering the opening section of the pressure chamber is heat-welded at the peripheral part of the opening section on the body of the self-sealing unit in the state of being pressed onto the peripheral part. As a result, there may occur a case where the film of the area corresponding to a part of the pressure chamber which is relatively large due to the eccentrical displacement of the valving element is stretched with a higher tension in comparison with the film of the area corresponding to a relatively small part on the opposite side.

As described above, in the case where the tension of a part of the film is higher than that of other parts, there may occur a case where the valving element cannot be moved by a predetermined negative pressure. Consequently, the valving element does not open sufficiently in this case, and smooth supply of ink to the ink ejecting head is retarded.

Such a problem is not limited to ink ejecting head units. The problem similarly exists in liquid ejecting head units for ejecting liquid other than ink.

SUMMARY

An advantage of some aspects of the invention is to provide a self-sealing unit capable of stably opening/closing a flow path under the action of a predetermined negative pressure, a liquid ejecting head unit, and a liquid ejecting apparatus having the self-sealing unit.

According to an aspect of the invention for achieving the above advantage, there is provided a self-sealing unit in which a liquid supply route for supplying liquid of a liquid source to a liquid ejecting head is formed, the self-sealing unit including: a pressure chamber formed at the mediate on the liquid supply route; a valving element that opens or closes the liquid supply route to supply the liquid to the pressure chamber; a biasing member that biases the valving element toward the direction to close the liquid supply route; a film that is fixed to the body of the self-sealing unit to demarcate the pressure chamber and that causes the valving element to move against the biasing force of the biasing member so that the valving element is into an open state, by being displaced toward the pressure chamber side on the basis of a negative pressure acting in the pressure chamber and informing the displacement to the valving element; and a convex section arranged at a position between the valving element and a wall surface of the pressure chamber, where the distance between the valving element and the wall surface is shorter than that in other areas, away from the valving element and the wall surface in a manner that the convex section supports the film.

According to this aspect, the convex section is arranged at a position between the valving element and a wall surface of the pressure chamber, where the distance between the valving element and the wall surface is shorter than that in other areas. As a result, deflection of the film of an area of the pressure chamber where the distance between the wall of the pressure chamber and the valving element is short because of the eccentricity of the valving element, which is caused by a negative pressure, is controlled by the convex section, and accordingly, the negative pressure effectively acts on a large area of the pressure chamber on the opposite side.

Consequently, even if the tension of the film of the large area is high, the film sufficiently deflects as a whole, and the valving element is moved on the basis of this deflection. As a result, it is possible to cause performing a smooth operation of opening the flow path.

Furthermore, since the convex section is arranged away from the valving element and the wall surface of the pressure chamber in a manner that it supports the film, an air bubble which may occur in the pressure chamber flows via the gap between the convex section and the wall surface of the pressure chamber without staying in the pressure chamber. When an air bubble is near a wall surface, it easily adheres to the wall surface and stays there. Furthermore, a fine air bubble does not exit and remains even downstream, and therefore, it is preferable that an air bubble be large to some extent. According to this aspect, it is possible to get an air bubble away from a wall surface, and it is also possible to discharge an air bubble which has grown to some extent to downstream through a gap between the convex section and a wall surface of the pressure chamber. Thus, an excellent bubble dischargeability is also obtained.

Here, it is preferable that the self-sealing unit have a pressure receiving plate fixed to the film and be configured so that the valving element is moved via the pressure receiving plate. It is preferable because, since deflection of the film on the basis of the action of a negative pressure on the film can be informed to the valving element via the pressure receiving plate in this case, pressing force by the film be preferably informed to the valving element. Here, the self-sealing unit may be configured so that the film comes into contact with the convex section with the displacement of the film toward the pressure chamber side. Furthermore, the self-sealing unit may be configured so that the end part of the pressure receiving plate comes into contact with the convex section with the displacement of the film toward the pressure chamber side. Furthermore, the film may be fixed to the convex section.

According to another aspect of the invention, there is provided a liquid ejecting head unit configured by combining a liquid ejecting head that discharges a liquid drop from a nozzle opening of a nozzle plate by using a pressure caused by displacement of a pressure generator and a self-sealing unit in which a liquid supply route for supplying liquid for the liquid ejecting head is formed, wherein the self-sealing unit is any one of those described above.

According to this aspect, since liquid is smoothly supplied from the self-sealing unit, it is possible to improve the characteristic of discharging liquid from the liquid ejecting head.

According to another aspect of the invention, there is provided a liquid ejecting apparatus including the liquid ejecting head unit described above.

According to this aspect, it is possible to perform high-quality printing with the liquid ejecting head to which liquid is smoothly supplied from the self-sealing unit.

BRIEF DESCRIPTION OF THE DRAWINGS

The invention will be described with reference to the accompanying drawings, wherein like numbers reference like elements.

DESCRIPTION OF EXEMPLARY EMBODIMENT

Figure 1:
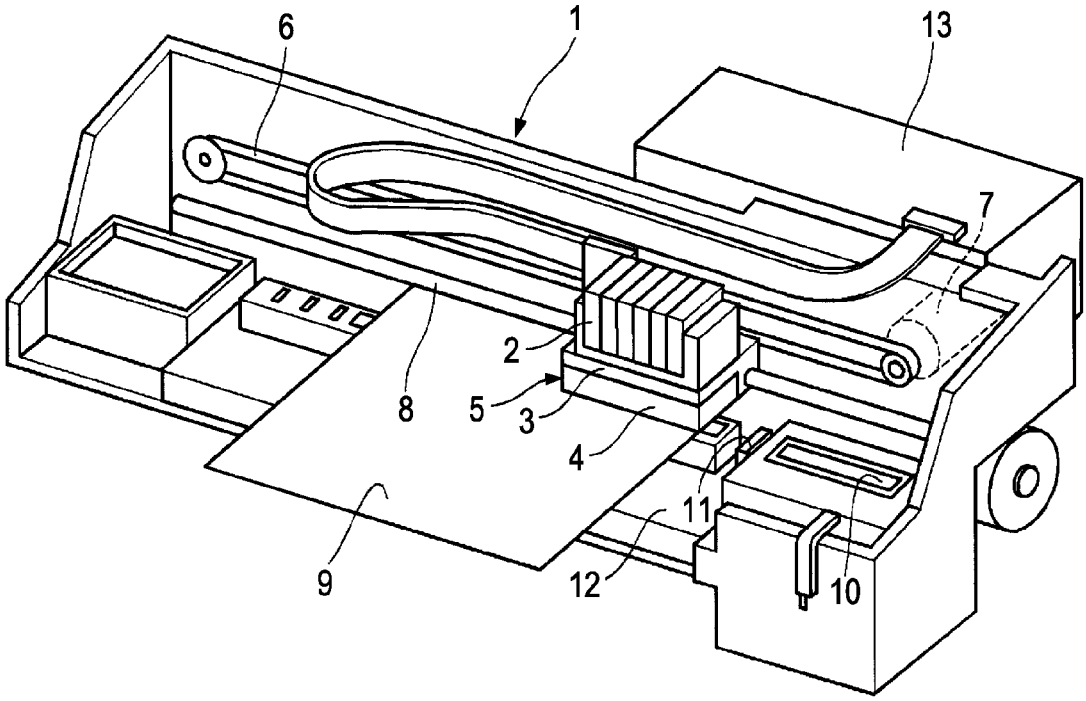
FIG. 1 is a schematic configuration diagram of an ink-jet-type recording apparatus.
Figure 2:
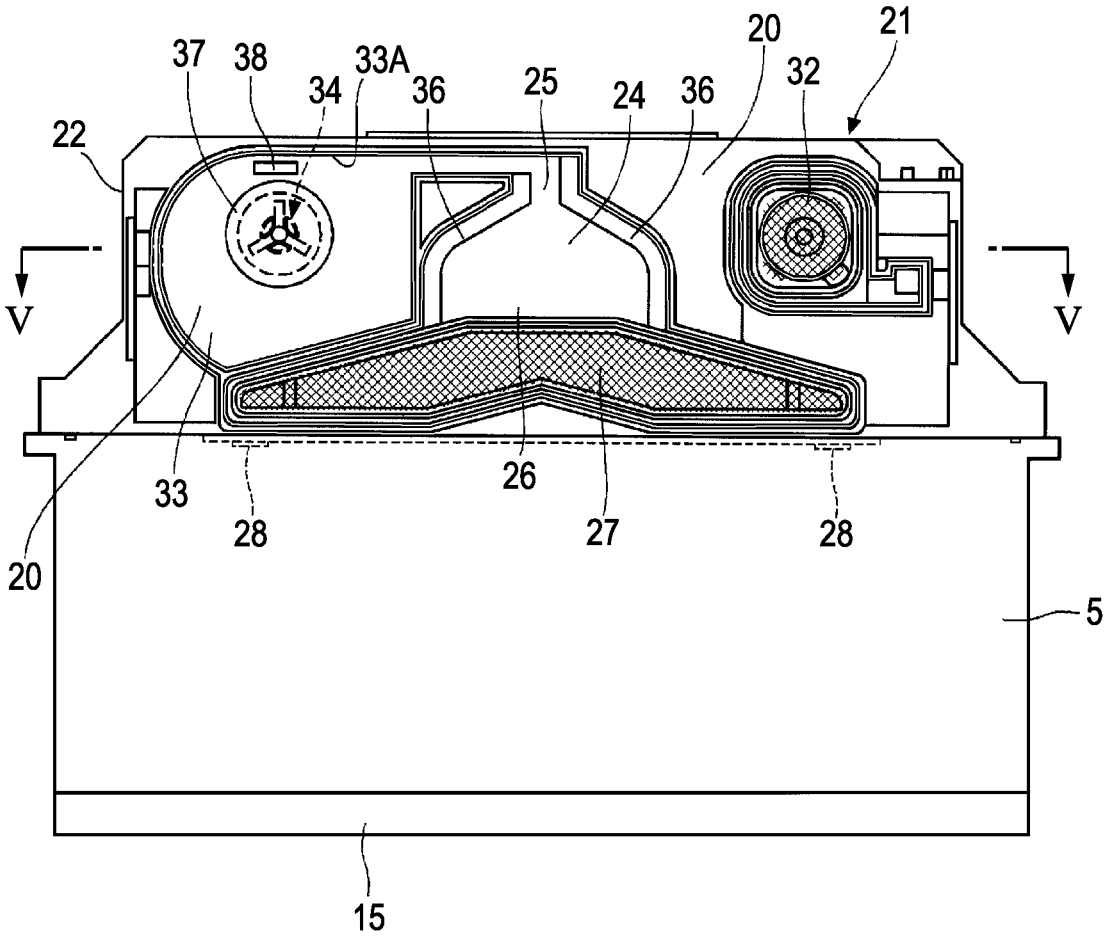
FIG. 2 is a sectional view of main sections of an ink ejecting head.
Figure 3:
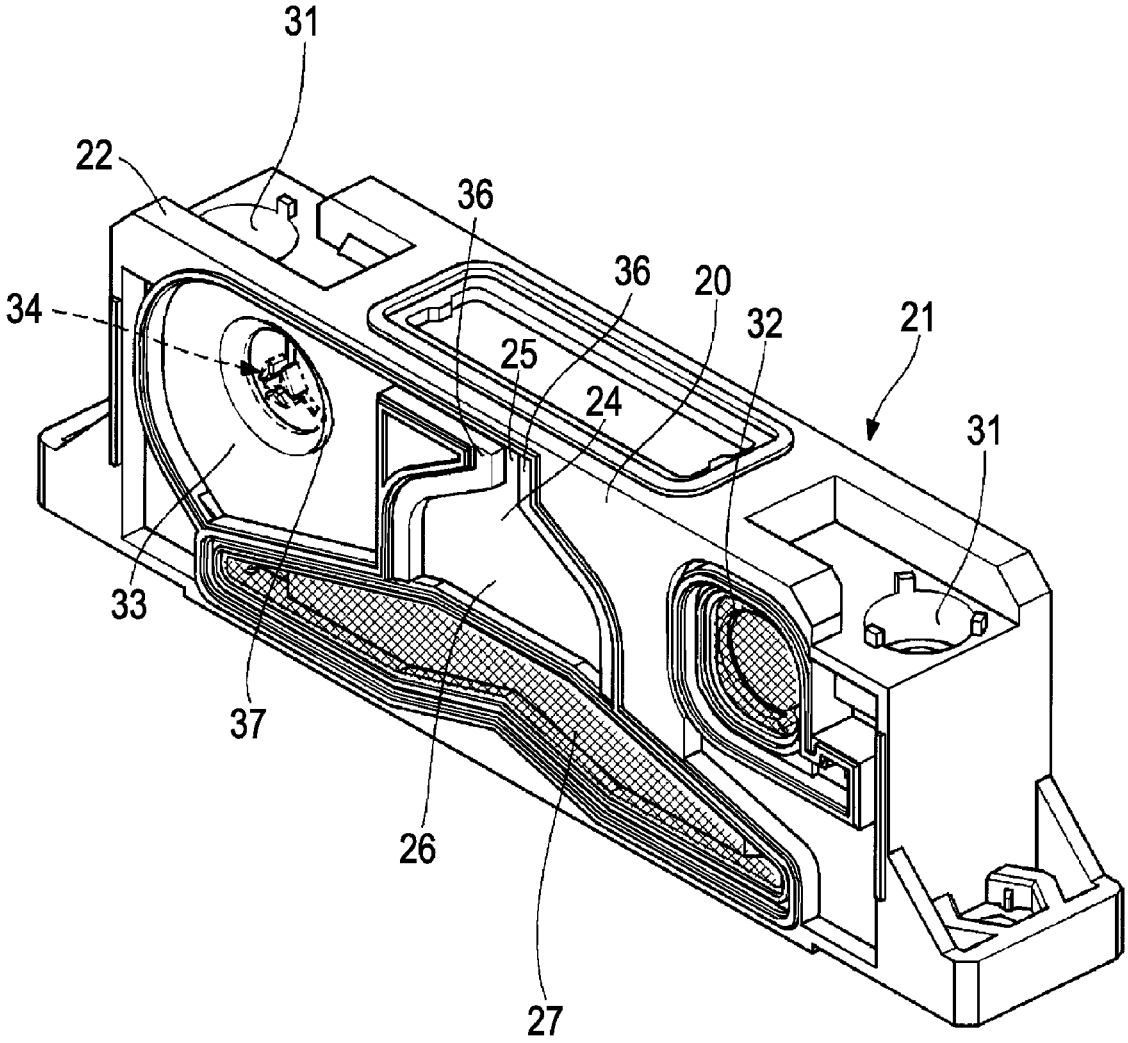
FIG. 3 is an external view of a self-sealing unit.
Figure 4:
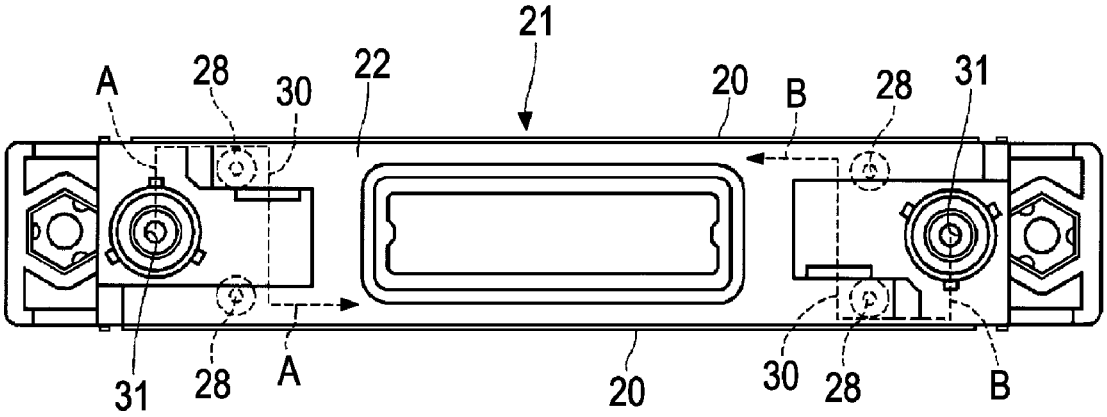
FIG. 4 is a plane view of FIG. 2.
Figure 5:
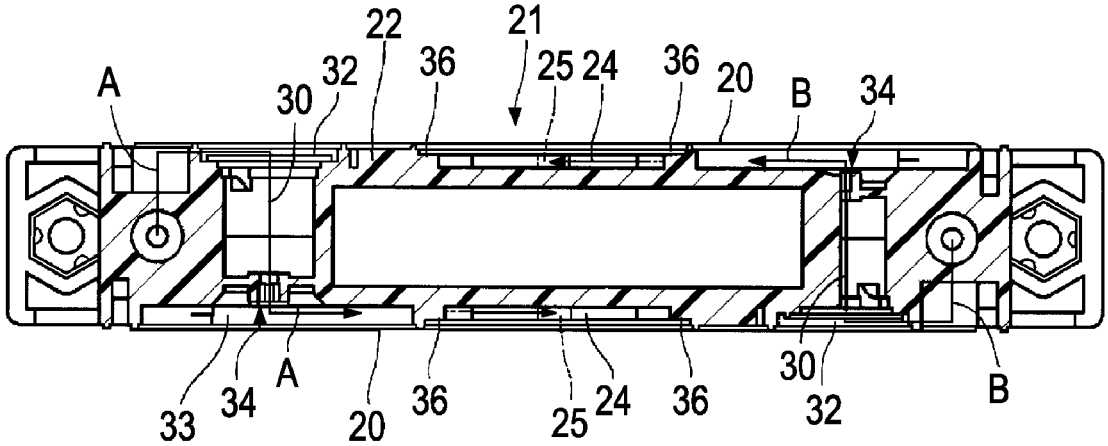
FIG. 5 is a V-V line arrow view of FIG. 2.

FIG. 1 shows a schematic configuration of an ink-jet-type recording apparatus provided with an ink ejecting head according to an embodiment of the invention. FIG. 2 shows the cross section of main sections of the ink ejecting head. FIG. 3 shows an external view of a self-sealing unit. FIG. 4 shows a plane view of FIG. 2. FIG. 5 shows a V-V line arrow view of FIG. 2.

An ink-jet-type recording apparatus will be described on the basis of FIG. 1. As shown in the FIG. 1, an ink-jet-type recording apparatus 1 as a liquid ejecting apparatus has an ink ejecting head 5 as a liquid ejecting head in which a carriage 3 mounted with an ink cartridge 2, a recording head 4 attached to the carriage 3, and the like are integrated. The carriage 3 is connected to a stepping motor 7 via a timing belt 6, and it reciprocates in the sheet width direction (the main scanning direction) of a recording sheet 9 by being guided by a guide bar 8. The carriage 3 forms a box shape the upper part of which is open. The recording head 4 is attached to the carriage 3 in a manner that the nozzle surface of the recording head 4 is exposed on its surface facing the recording sheet 9 (its undersurface), and the ink cartridge 2 is contained in the carriage 3.

Ink is supplied to the recording head 4 from the ink cartridge 2. By discharging ink drops onto the surface of the recording sheet 9 while moving the carriage 3, an image or a character is printed on the recording sheet 9 as a dot matrix. In FIG. 1, reference numeral 10 denotes a cap for preventing the nozzle from getting dry by sealing the nozzle opening of the recording head 4 while printing is stopped as well as for performing a cleaning operation by causing a negative pressure to act on the nozzle surface of the recording head 4. Reference numeral 11 denotes a wiper blade for wiping the nozzle surface of the recording head 4. Reference numeral 12 denotes a waste ink storage section for storing waste ink absorbed by a cleaning operation. Reference numeral 13 denotes a control device for controlling the operation of the ink-jet-type recording apparatus 1.

The ink ejecting head 5 shown in the FIG. 1 is provided with a self-sealing unit (not shown in FIG. 1) that is also a flow path forming member in which a flow path for supplying ink to the recording head 4 from the ink cartridge 2 is formed. In the example of FIG. 1, description has been made on the case where the ink cartridge 2 as a liquid source is contained in the carriage 3. However, the invention can be also applied to an ink-jet-type recording apparatus with a configuration in which the ink cartridge 2 is contained in a section different from the carriage 3, and ink is pressure-transported to the flow path forming member of the recording head 4 via a supply tube.

Next, the ink ejecting head 5 will be described on the basis of FIG. 2. As shown in the FIG. 2, the ink ejecting head 5 is provided with a pressure generator such as, for example, a piezoelectric element, and it discharges an ink drop from the nozzle opening of a nozzle plate 15 using a pressure caused by displacement of the piezoelectric element. The ink ejecting head 5 is provided with a reservoir chamber, and a self-sealing unit 21 is fixed to the top of the ink ejecting head 5. Ink as fluid is supplied to a head flow path of the ink ejecting head 5 from the self-sealing unit 21, and the ink is sent to the reservoir chamber from the head flow path. The self-sealing unit 21 is supplied with ink from the ink cartridge 2. For example, ink is supplied to the self-sealing unit 21 from the ink cartridge 2 via a supply tube or an ink supply needle.

The self-sealing unit 21 will be concretely described on the basis of FIGS. 2 to 6. As shown in these figures, the self-sealing unit 21 is in a rectangular parallelepiped block shape having rectangular board surfaces. A main flow path 24 (flow path) and a pressure chamber 33 are formed on each of both board surfaces of a resin body 22 by providing a film 20 on the board surface with a part thereof heat-welded in a state of being pressed into the board surface. The width of the main flow path 24 is gradually widened (a wide-width part) from an entrance section 25 toward an exit section 26 (along the ink flow direction), and the exit section 26 is provided with a first filter 27. The first filter 27 is arranged at a large part of the board surface, with an area including the wide-width exit section 26, so that a large area is secured for it. The first filter 27 traps mainly foreign matters included in ink which has flowed through a valving element 34 (mechanical component member) to be described later.

The first filter 27 has a surface along the ink flow direction (a surface in parallel with the board surface), and ink which has flowed through the main flow path 24 is sent to the lower part of the inside of the body 22 from the outside of the board surface via the first filter 27, and sent to the ink ejecting head 5 (see FIG. 2) from two discharge holes 28. Ink sent to the main flow path 24 spreads from a narrow part of the flow path to a wide part of the flow path (spreads in the width direction of the exit section) and is sent to one reservoir chamber of the ink ejecting head 5 (see FIG. 2) from the discharge holes 28 at the end parts. That is, each of the main flow paths 24 is provided with two discharge holes 28 connecting to one reservoir chamber, and four discharge holes 28 are provided for one self-sealing unit 21 (see FIG. 4).

At each of the end parts of the top part of the self-sealing unit 21, an ink introduction hole 31 is provided, and ink is supplied to each ink introduction hole 31 from the ink cartridge 2. Ink supplied into one ink introduction hole 31 (on the left side in FIG. 4) is sent to the entrance section 25 of the main flow path 24 shown in FIG. 2 via a predetermined flow path 30, and ink provided for the other ink introduction hole 31 (on the right side in FIG. 4) is sent to the entrance section 25 of the main flow path 24 provided on the back side of the self-sealing unit 21 in FIG. 2 via a predetermined flow path 30.

As shown by an arrow A in FIG. 4, the flow path 30 connecting to one ink introduction hole 31 (on the left side in FIG. 4) is formed so that the ink supplied into the ink introduction hole 31 goes toward the lower side after flowing along the upper side in FIGS. 4 and 5, and is sent to the pressure chamber 33 shown in FIG. 2 via a second filter 32. As shown by an arrow B in FIG. 4, the other flow path 30 connecting to the other ink introduction hole 31 (on the right side in FIG. 4) is formed so that the ink supplied into the ink introduction hole 31 flows along the lower side in FIGS. 4 and 5, goes toward the upper side in FIGS. 4 and 5 via the second filter 32 shown in FIG. 2, and is sent to the pressure chamber 33 existing on the back side of the self-sealing unit 21 in FIG. 2. The second filter 32 has a surface in parallel with the board surface and is arranged parallel to the first filter 27.

The valving element 34 is provided on each flow path 30 between the ink introduction hole 31 (the second filter 32) and the pressure chamber 33 (the entrance section 25 of the main flow path 24). The valving element 34 operates so as to allow ink to flow when the pressure in the reservoir chamber of the ink ejecting head 5 (see FIG. 2) decreases, that is, when ink is discharged and the pressure on the main flow path 24 side gets relatively low.

That is, in a state that ink is supplied from the ink introduction hole 31 by a predetermined pressure, when ink is stored in the reservoir chamber of the ink ejecting head 5 (see FIG. 2), the valving element 34 is in a closed state, and, when the pressure on the rear stream side is decreased by discharge of ink, the valving element 34 is caused to be into an open state by a negative pressure which occurs with the pressure decrease, and ink is supplied. In other words, the film 20 is displaced toward the pressure chamber 33 side on the basis of the negative pressure which acts in the pressure chamber 33 then, and this displacement is informed to the valving element 34. Thereby, the valving element 34 is moved against the biasing force of a spring (not shown in FIGS. 2 to 5) which acts on the valving element 34, via a pressure receiving plate 37, and an open state between the flow path 30 and the pressure chamber 33 occurs. Here, the pressure receiving plate 37 is a round member integratedly fixed to the film 20. When the film 20 is displaced toward the pressure chamber 33 side with occurrence of a negative pressure as described before, the pressure receiving plate 37 comes into contact with the valving element 34 and causes it to move. Though the pressure chamber 33 is round, the valving element 34 and the pressure receiving plate 37 are arranged eccentrically from the center of the pressure chamber 33.

The pressure chamber 33 in this embodiment is provided with a convex section 38 projecting toward the film 20. This convex section 38 is provided at a position between the valving element 34 and a wall surface 33A of the pressure chamber 33, where the distance between the valving element 34 and the wall surface 33A is shorter than that in other areas, that is, in an area in the pressure chamber 33 which is relatively small because of the eccentricity of the valving element 34. In the case of FIG. 2, the convex section 38 is provided at the upper part of the pressure chamber 33 where the distance between the valving element 34 and the wall surface 33A is the shortest. Accordingly, when the film 20 is displaced toward the pressure chamber 33 side by the action of a negative pressure in this embodiment, the film 20 comes into contact with the end of the convex section 38, and the movement at this part is controlled.

Furthermore, the convex section 38 is provided away from the valving element 34 and the wall surface 33A. As a result, even if an air bubble occurs near the convex section 38 in the pressure chamber 33, the air bubble is preferably discharged through between the valving element 34 and the convex section 38 and through between the convex section 38 and the wall surface 33A.

A further detailed structure of the pressure chamber 33 and its related sections will be described on the basis of FIG. 6, which is a schematic cross-sectional view conceptually illustrating this part which has been extracted and enlarged. As shown in the FIG. 6, the valving element 34 and the pressure receiving plate 37 are arranged eccentrically from the center of the round pressure chamber 33. The convex section 38 is arranged at a position between the valving element 34 and the wall surface 33A of the pressure chamber 33, where the distance between the valving element 34 and the wall surface 33A is the shortest, away from the valving element 34 and the wall surface 33A. That is, the convex section 38 is provided in an area where the distance between the valving element 34 and the wall surface 33A is narrow because of the eccentricity.

Figure 6A:
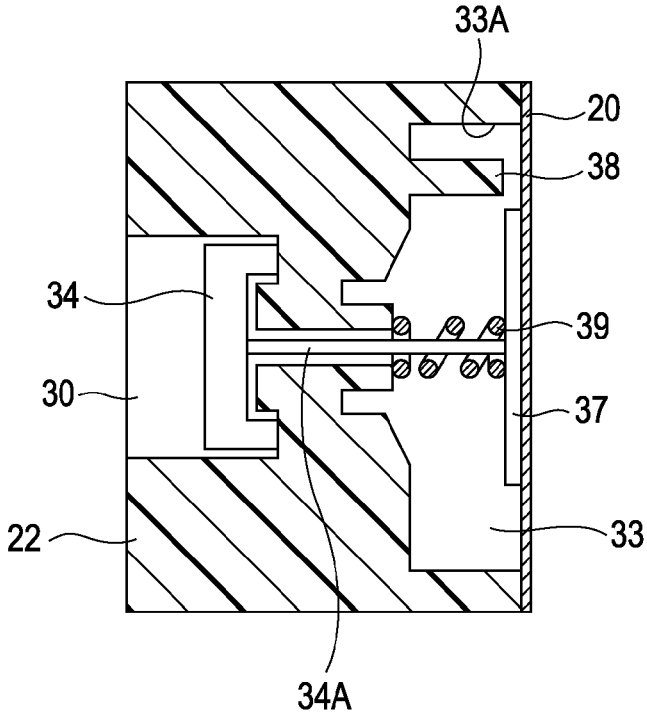
FIGS. 6A and 6B are a schematic cross-sectional view in which a pressure chamber part in FIG. 3 is extracted and conceptually shown.
Figure 6B:
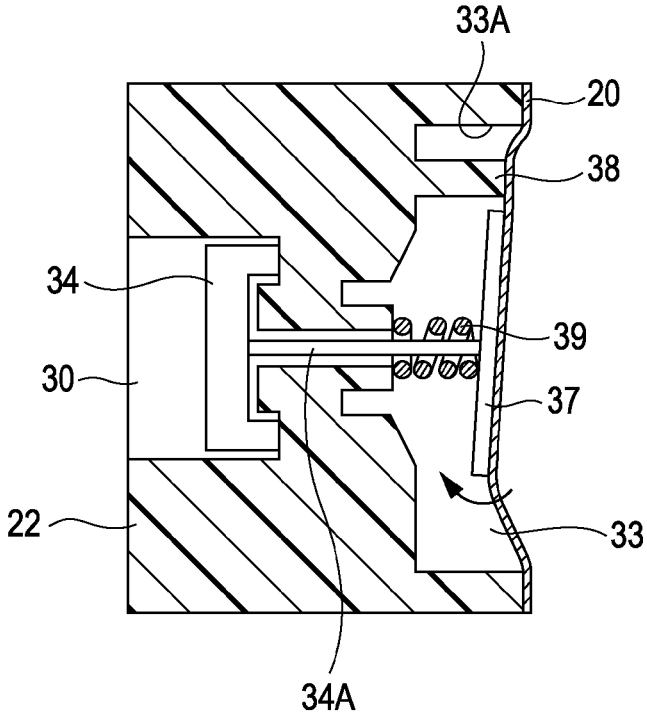

Especially as shown in FIG. 6A, when a negative pressure does not act in the pressure chamber 33, the flow path 30 is closed by the valving element 34 arranged between the flow path 30 and the pressure chamber 33 in the body 22. This is because the valving element 34 is biased toward the right direction in the FIG. 6A by the biasing force of a spring 39, which is a biasing member put into around a shaft 34A of the pressure receiving plate 37. Here, the end of the shaft 34A is fixed to the pressure receiving plate 37.

When a negative pressure acts in the pressure chamber 33 in such a state, the film 20 is displaced toward the pressure chamber 33 side. However, a part of the film 20 comes into contact with the convex section 38 in the area which is small because of the eccentricity, so that the displacement is controlled. As a result, the film 20 is into a cantilever structure with the convex section 38 as a fulcrum, and the film 20 of the opposite side area which is large because of the eccentricity is displaced, turning anticlockwise as shown by an arrow in the FIG. 6B. That is, it is possible to effectively cause the negative pressure to act on the area which is large because of the eccentricity. As a result, the film 20 sufficiently deflects as a whole even if the tension of the film 20 of the large area is high, and the valving element 34 is moved on the basis of this deflection. Consequently, it is possible to cause a smooth operation of opening the flow path 30 to be performed.

Furthermore, since the convex section 38 is arranged away from the valving element 34 and the wall surface 33A of the pressure chamber 33 in a manner that it supports the film 20, an air bubble which may occur in the pressure chamber 33 flows via the gap between the convex section 38 and the wall surface 33A of the pressure chamber 33 without staying in the pressure chamber 33.

Furthermore, there is formed a shelf section 36 as a step section extending in the ink transport direction (the vertical direction in FIG. 2) in the main flow path 24 of the self-sealing unit 21 of this embodiment. The shelf sections 36 are formed at the end parts (both side end parts of the wide-width part) of the main flow path 24, and the depth of the shelf section 36 is shallow. By providing the shelf sections 36 at the end parts of the main flow path 24, such a situation is avoided that, when an air bubble enters the main flow path 24, it floats in the narrow flow path near the entrance section 25 and enters the shelf section 36 with a shallow depth. Accordingly, even if an air bubble enters the main flow path 24, ink is supplied to the ink ejecting head 5 (see FIG. 2) via the shelf section 36.

In the ink ejecting head unit of this embodiment, a negative pressure occurs in its reservoir by the ink ejecting head 5 discharging an ink drop via the nozzle opening. Since this negative pressure acts in the pressure chamber 33 of the self-sealing unit 21, the film 20 is displaced toward the pressure chamber 33 side. The film 20 corresponding to an area which is small because of eccentricity comes into contact with the convex section 38 then, and thereby the film 20 is into a cantilever structure. Consequently, it is possible to concentrate the negative pressure on the film 20 corresponding to an area which is large because of the eccentricity. As a result, it is possible to cause the valving element 34 to be preferably into an open state by a predetermined negative pressure and supply ink to the ink ejecting head 5 via the flow path 30.

Furthermore, even if an air bubble occurs in the area which is small because of the eccentricity in the pressure chamber 33 then, the air bubble is preferably discharged through between the valving element 34 and the convex section 38 and through between the convex section 38 and the wall surface 33A.

Figure 7:
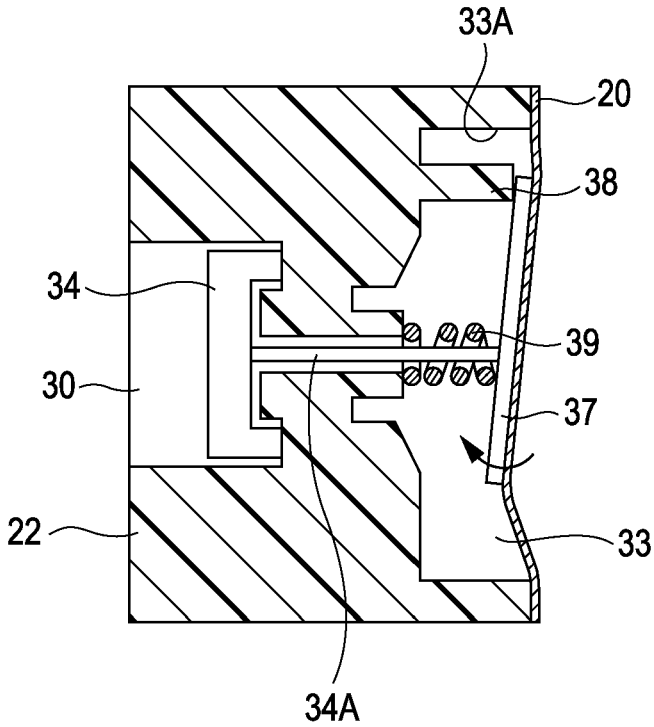
FIG. 7 is a schematic cross-sectional view illustrating a variation example of FIG. 6.
Figure 8:
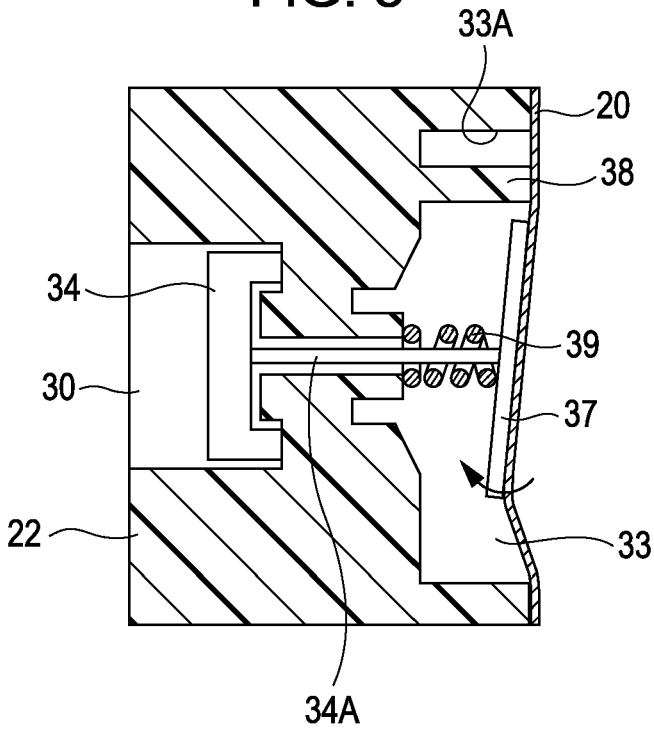
FIG. 8 is a schematic cross-sectional view illustrating another variation example of FIG. 6.

Though, in the case shown in FIG. 6, a configuration is made so that the film 20 comes into contact with the convex section 38, this is not limited thereto. It is also possible to make a configuration so that the end part of the pressure receiving plate 37 comes into contact with the convex section 38 with displacement of the film 20 toward the pressure chamber 33 side, as shown in FIG. 7. Furthermore, as shown in FIG. 8, even if the film 20 is fixed to the convex section 38, a similar operation/advantage can be obtained. That is, in any of the cases, it is possible not only to cause a negative pressure to effectively act on an area which is large because of the eccentricity but also to ensure preferable air bubble dischargeability, due to the cantilever structure of the film 20. In FIGS. 7 and 8, the same sections as those in FIG. 6 are given the same reference numerals.

Though the convex section 38 projects from the pressure chamber 33 side in the above embodiment, it may project from the film 20 side on the contrary.

Furthermore, though description has been on an ink-jet-type recording head as an example of a liquid ejecting head in the embodiment described above, the invention widely covers all general liquid ejecting heads. Of course, the invention can be applied to liquid ejecting heads for ejecting liquid other than ink. Other liquid ejecting heads include, for example, various recording heads used for an image recording apparatus such as a printer, a color material ejecting head used for manufacture of a color filter for a liquid crystal display or the like, an electrode material ejecting head used for formation of an electrode for an organic EL display, a FED (field emission display) and the like, a bioorganic compound ejecting head used for manufacture of a biochip, and the like.

What is claimed is:

1. A self-sealing unit in which a liquid supply route for supplying liquid of a liquid source to a liquid ejecting head is formed, the self-sealing unit comprising:

a pressure chamber formed on the liquid supply route;

a valving element that opens or closes the liquid supply route to supply the liquid to the pressure chamber;

a biasing member that biases the valving element toward the direction to close the liquid supply route;

a film that is fixed to the body of the self-sealing unit to demarcate the pressure chamber and that causes the valving element to move against the biasing force of the biasing member so that the valving element is into an open state, by being displaced toward the pressure chamber side on the basis of a negative pressure acting in the pressure chamber and informing the displacement to the valving element; and a convex section arranged at a position between the valving element and a wall surface of the pressure chamber, where the distance between the valving element and the wall surface is shorter than that in other areas, away from the valving element and the wall surface in a manner that the convex section supports the film.

2. The self-sealing unit according to claim 1, comprising: a pressure receiving plate fixed to the film, wherein the displacement of the valving element is made via the pressure receiving plate.

3. The self-sealing unit according to claim 2, wherein the convex section is configured so as to come into contact with the film with the displacement of the film toward the pressure chamber side.

4. The self-sealing unit according to claim 2, wherein the convex section is configured so as to come into contact with the end part of the pressure receiving plate with the displacement of the film toward the pressure chamber side.

5. The self-sealing unit according to claim 2, wherein the film is fixed to the convex section.

6. A liquid ejecting head unit comprising:

a liquid ejecting head that discharges a liquid drop from a nozzle opening of a nozzle plate by using a pressure caused by displacement of a pressure generator; and a self-sealing unit in which a liquid supply route for supplying liquid to the liquid ejecting head is formed, wherein the self-sealing unit includes:

a pressure chamber formed on the liquid supply route;

a valving element that opens or closes the liquid supply route to supply the liquid to the pressure chamber;

a biasing member that biases the valving element toward the direction to close the liquid supply route;

a film that is fixed to the body of the self-sealing unit to demarcate the pressure chamber and that causes the valving element to move against the biasing force of the biasing member so that the valving element is into an open state, by being displaced toward the pressure chamber side on the basis of a negative pressure acting in the pressure chamber and informing the displacement to the valving element; and a convex section arranged at a position between the valving element and a wall surface of the pressure chamber, where the distance between the valving element and the wall surface is shorter than that in other areas, away from the valving element and the wall surface in a manner that the convex section supports the film.

7. The liquid ejecting head unit according to claim 6, wherein the self-sealing unit further comprises a pressure receiving plate fixed to the film, wherein the displacement of the valving element is made via the pressure receiving plate.

8. The liquid ejecting head unit according to claim 7, wherein the convex section is configured so as to come into contact with the film with the displacement of the film toward the pressure chamber side.

9. The liquid ejecting head unit according to claim 7, wherein the convex section is configured so as to come into contact with the end part of the pressure receiving plate with the displacement of the film toward the pressure chamber side.

10. The liquid ejecting head unit according to claim 7, wherein the film is fixed to the convex section.

11. A liquid ejecting apparatus comprising a liquid ejecting head unit that includes:

a liquid ejecting head that discharges a liquid drop from a nozzle opening of a nozzle plate by using a pressure caused by displacement of a pressure generator; and a self-sealing unit in which a liquid supply route for supplying liquid to the liquid ejecting head is formed, wherein the self-sealing unit includes:

a pressure chamber formed on the liquid supply route;

a valving element that opens or closes the liquid supply route to supply the liquid to the pressure chamber;

a biasing member that biases the valving element toward the direction to close the liquid supply route;

a film that is fixed to the body of the self-sealing unit to demarcate the pressure chamber and that causes the valving element to move against the biasing force of the biasing member so that the valving element is into an open state, by being displaced toward the pressure chamber side on the basis of a negative pressure acting in the pressure chamber and informing the displacement to the valving element; and a convex section arranged at a position between the valving element and a wall surface of the pressure chamber, where the distance between the valving element and the wall surface is shorter than that in other areas, away from the valving element and the wall surface in a manner that the convex section supports the film.

12. The liquid ejecting apparatus according to claim 11, wherein the self-sealing unit further comprises a pressure receiving plate fixed to the film, wherein the displacement of the valving element is made via the pressure receiving plate.

13. The liquid ejecting apparatus according to claim 12, wherein the convex section is configured so as to come into contact with the film with the displacement of the film toward the pressure chamber side.

14. The liquid ejecting apparatus according to claim 12, wherein the convex section is configured so as to come into contact with the end part of the pressure receiving plate with the displacement of the film toward the pressure chamber side.

15. The liquid ejecting apparatus according to claim 12, wherein the film is fixed to the convex section.

* * * * *